US011162267B1

(12) United States Patent
Santini

(10) Patent No.: US 11,162,267 B1
(45) Date of Patent: Nov. 2, 2021

(54) ADJUSTABLE TELESCOPING PLANK

(71) Applicant: Patrick J. Santini, West Bend, WI (US)

(72) Inventor: Patrick J. Santini, West Bend, WI (US)

( * ) Notice: Subject to any disclaimer, the term of this patent is extended or adjusted under 35 U.S.C. 154(b) by 426 days.

(21) Appl. No.: 16/396,458

(22) Filed: Apr. 26, 2019

(51) Int. Cl.
*E04G 5/08* (2006.01)
*E04G 1/15* (2006.01)

(52) U.S. Cl.
CPC ..... *E04G 5/08* (2013.01); *E04G 2001/157* (2013.01)

(58) Field of Classification Search
CPC ..... E04G 3/24; E04G 3/246; E04G 3/243; E04G 5/08; E04G 2001/157
See application file for complete search history.

(56) References Cited

U.S. PATENT DOCUMENTS 962,691 A * 6/1910 Andersen ..... E04G 1/152 182/223
1,836,126 A * 12/1931 Luce ..... A47B 57/26 108/42
2,880,920 A * 4/1959 Glessner ..... E06C 1/22 182/166
3,054,645 A 4/1960 Evans
3,352,380 A * 11/1967 Barney ..... A01D 46/20 182/131
3,556,254 A * 1/1971 Lambert ..... E04G 5/08 182/223
4,366,774 A * 1/1983 Haake ..... A01K 31/12 108/143
4,620,612 A * 11/1986 Enoki ..... B63C 5/02 182/113
5,033,584 A * 7/1991 Battle ..... E06C 1/12 182/168
5,301,770 A * 4/1994 Regan ..... E04G 3/30 182/128
6,290,395 B1 9/2001 Pletschet
8,186,480 B1 * 5/2012 Yoakum, Jr. ..... E06C 1/39 182/118
8,678,135 B2 * 3/2014 Crook ..... B66F 11/042 182/69.6
8,733,738 B2 * 5/2014 Mun ..... B23P 21/00 254/122
9,228,364 B1 * 1/2016 Dubose ..... E04G 1/15
9,822,538 B2 * 11/2017 Taylor ..... E04G 5/08
(Continued)

FOREIGN PATENT DOCUMENTS

KR 102252968 B1 * 5/2021

*Primary Examiner* — Colleen M Chavchavadze
(74) *Attorney, Agent, or Firm* — Donald J. Ersler

(57) ABSTRACT

An adjustable telescoping plank preferably includes an outer plank, an inner plank and a drive device. The outer plank includes a substantially rectangular cross section. The drive device is retained on an inside of substantially a first end of the outer plank. The inner plank includes a substantially rectangular cross section. A lead screw nut is retained on a first end of the inner plank. The inner plank is sized to be received by an inner surface of the outer plank. The drive device preferably includes a lead screw, a drive gear, a driven gear and a drive shaft. The drive shaft rotates the lead screw through the drive gear and driven gear. The lead screw engages the lead screw nut to axially move the inner plank relative to the outer plank. A contact member may be pivotally retained on a front of the inner plank.

18 Claims, 10 Drawing Sheets

(56) References Cited

U.S. PATENT DOCUMENTS

| | | | | |
|---|---|---|---|---|
| 10,233,065 | B2 * | 3/2019 | Jackson | B66F 11/046 |
| 10,322,920 | B2 * | 6/2019 | Shi | B66F 11/046 |
| 2005/0056484 | A1 * | 3/2005 | Fredette | E04G 1/24 182/62.5 |
| 2008/0302605 | A1 * | 12/2008 | St-Germain | E04G 1/36 182/223 |
| 2011/0073409 | A1 * | 3/2011 | Ricci | B63C 5/02 182/62.5 |
| 2012/0025507 | A1 * | 2/2012 | Berry, Jr. | E04G 1/24 280/769 |
| 2019/0316415 | A1 * | 10/2019 | Seo | E06C 1/39 |
| 2020/0260718 | A1 * | 8/2020 | Robbins | A01M 31/02 |

* cited by examiner

ADJUSTABLE TELESCOPING PLANK

BACKGROUND OF THE INVENTION

1. Field of the Invention

The present invention relates generally to support devices and more specifically to an adjustable telescoping plank, which may be used to provide a support surface for maintenance, construction or any other suitable purpose.

2. Discussion of the Prior Art

U.S. Pat. No. 3,054,645 to Evans discloses a mechanical slide. U.S. Pat. No. 6,290,395 to Pletschet discloses a linear slide assembly. U.S. Pat. No. 8,733,738 to Mun discloses a universal platform and aircraft assembly method using the same.

Accordingly, there is a clearly felt need in the art for an adjustable telescoping plank, which may be used to provide a support surface for maintenance, construction or any other suitable purpose.

SUMMARY OF THE INVENTION

The present invention provides an adjustable telescoping plank, which may be used to provide a support surface for maintenance, construction or any other suitable purpose. The adjustable telescoping plank preferably includes an outer plank, an inner plank and a drive device. The outer plank preferably includes a cross section having a base section, a first U-shaped member and a second U-shaped member. The first U-shaped member extends from a first side of the base section and the second U-shaped member extends from a second side of the base section. The drive device is retained inside a first end of the outer plank. A base wear strip is attached to an inside surface of the base section at a second end. A first side wear strip is attached to an inside surface of a side portion of the first U-shaped member at the second end. A second side wear strip is attached to an inside surface of a side portion of the second U-shaped member at the second end. A first bottom wear strip is attached to an inside surface of a bottom portion of the first U-shaped member at the second end. A second bottom wear strip is attached to an inside surface of a bottom portion of the second U-shaped member at the second end.

The drive device preferably includes an adjustment base plate, a tube housing, a lead screw, a drive gear, a driven gear and a drive shaft. The adjustment base plate is attached to an inside surface of the outer plank at substantially a first end thereof. An end of the tube housing is attached to the base plate at middle thereof. Upper and lower drive shaft holes are formed through a top and bottom of the tube housing to rotatably retain the drive shaft. A lead screw hole is formed through the adjustment base plate to rotatably retain a first end of the lead screw. The drive gear is attached to the drive shaft. The driven gear is attached to the first end of the lead screw. A drive cavity is formed in one end of the drive shaft to receive a drive bit of a manual or motor operated tool. A drive hole is formed through the base plate to provide access to the drive cavity. Rotation of the drive shaft rotates the drive gear, the driven gear and the lead screw.

The inner plank preferably includes a cross section having an inner base section, a first inner U-shaped member and a second inner U-shaped member. The first inner U-shaped member extends from a first side of the inner base section and the second inner U-shaped member extends from a second side of the inner base section. An inner end plate is attached to a first end of the inner plank. A lead screw nut is attached to a middle and outside surface of the inner end plate to threadably receive the lead screw. A lead screw tube is attached concentric with the lead screw nut and on inside surface of the inner end plate. A pair of top wear strips are attached to a top surface of the inner plank at opposing sides and at a first end thereof. A first side wear strip and a second side wear strip are attached to first and second outside side surfaces at opposing sides and at the first end thereof. First and second bottom wear strips are attached to bottom surfaces of the first and second inner U-shaped members at the first end thereof.

A contact member includes a pivoting frame and a contact pad. The pivoting frame preferably includes a top plate, a bottom plate, a front plate and a tube extension. The top plate extends backwards from a top edge of the front plate. The bottom plate extends backwards from a bottom edge of the front plate. A tube hole is formed through the bottom plate to receive tube extension. The tube extension is attached to a bottom of the top plate and to the bottom plate. The tube extension extends below the bottom plate. The contact pad is attached to a front of the front plate. Three pivot holes are formed through the top plate. If the contact member is used, a first curved slot, an inner pivot hole and a second curved slot are formed in a top of the inner plank at a second end. Three fasteners are used to pivotally secure the contact member to the inner plank.

Accordingly, it is an object of the present invention to provide an adjustable telescoping plank, which may be used to provide a support surface for maintenance, construction or any other suitable purpose.

These and additional objects, advantages, features and benefits of the present invention will become apparent from the following specification.

DETAILED DESCRIPTION OF THE PREFERRED EMBODIMENTS

Figure 1:
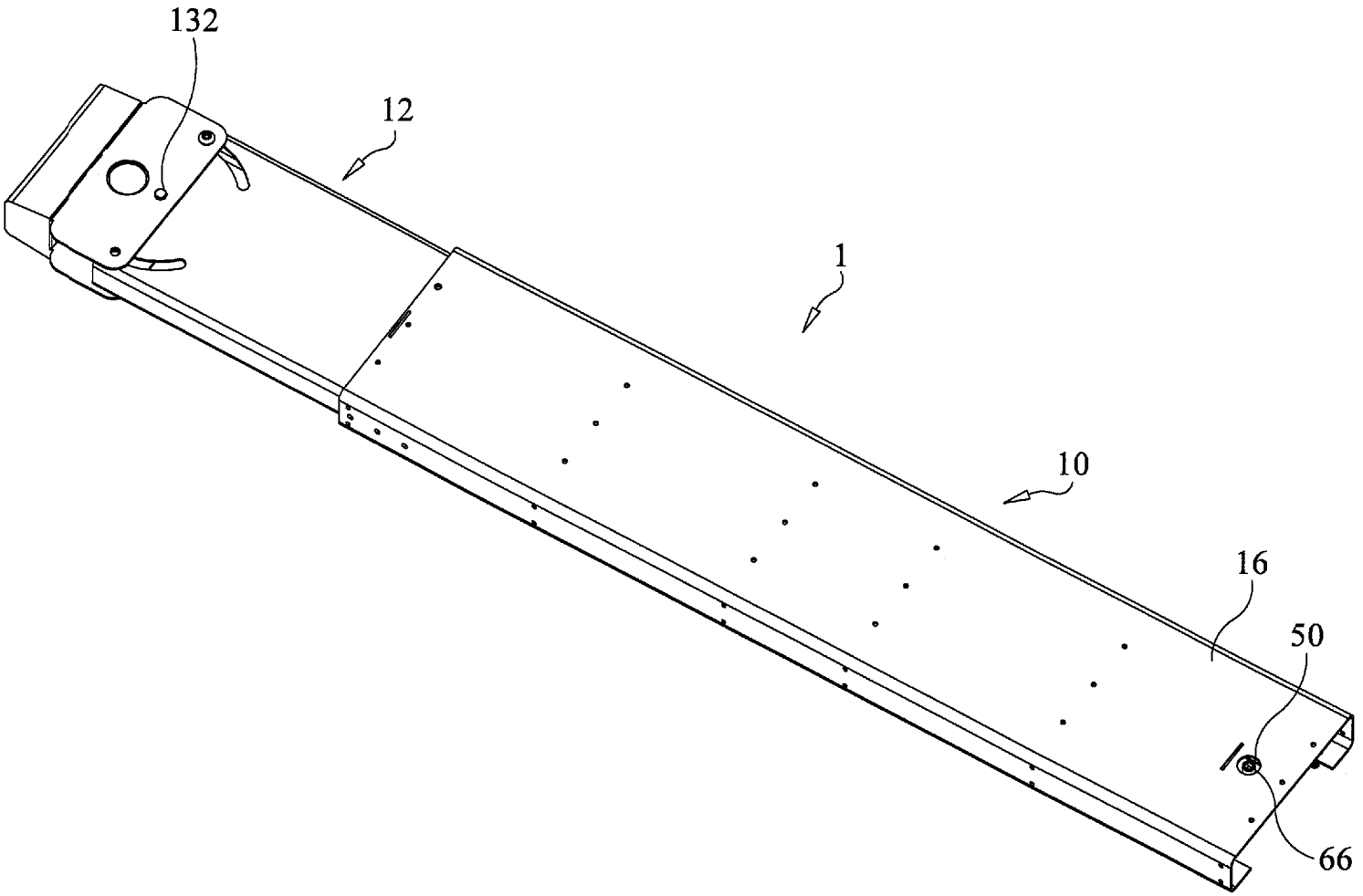
FIG. 1 is a perspective view of an adjustable telescoping plank in accordance with the present invention.
Figure 2:
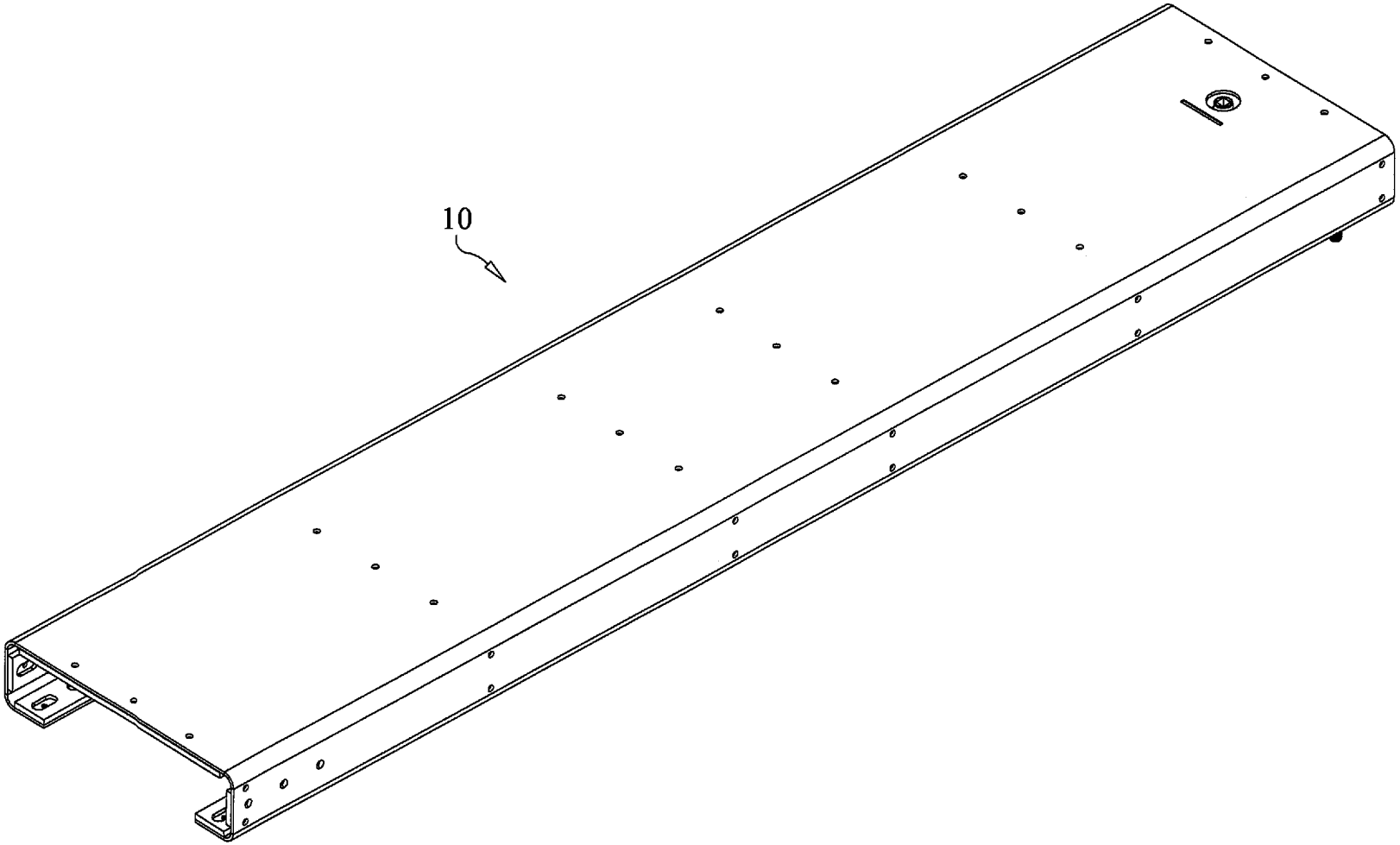
FIG. 2 is a top perspective view of an outer plank of an adjustable telescoping plank in accordance with the present invention.
Figure 3:
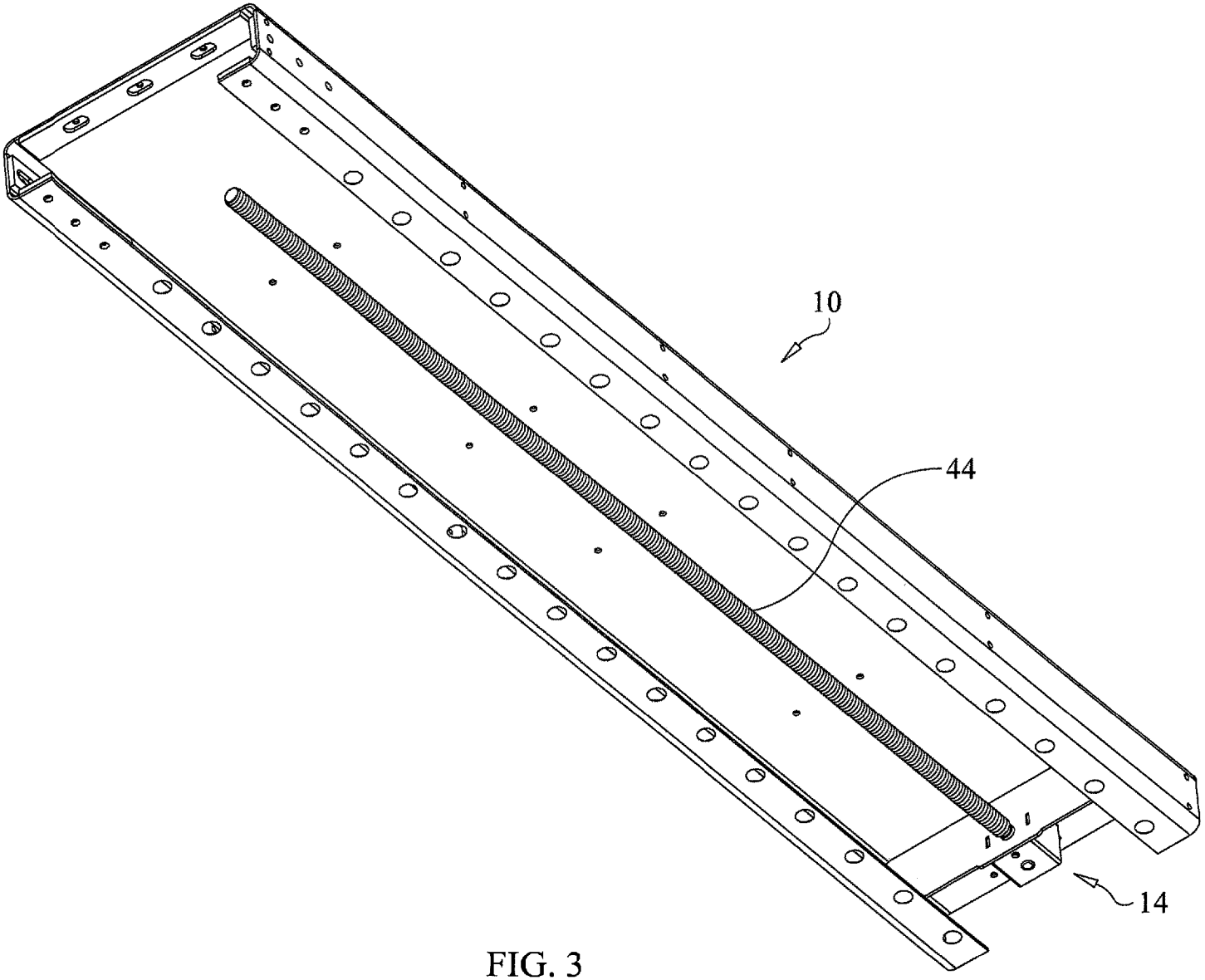
FIG. 3 is a bottom perspective view of an outer plank of an adjustable telescoping plank in accordance with the present invention.
Figure 4:
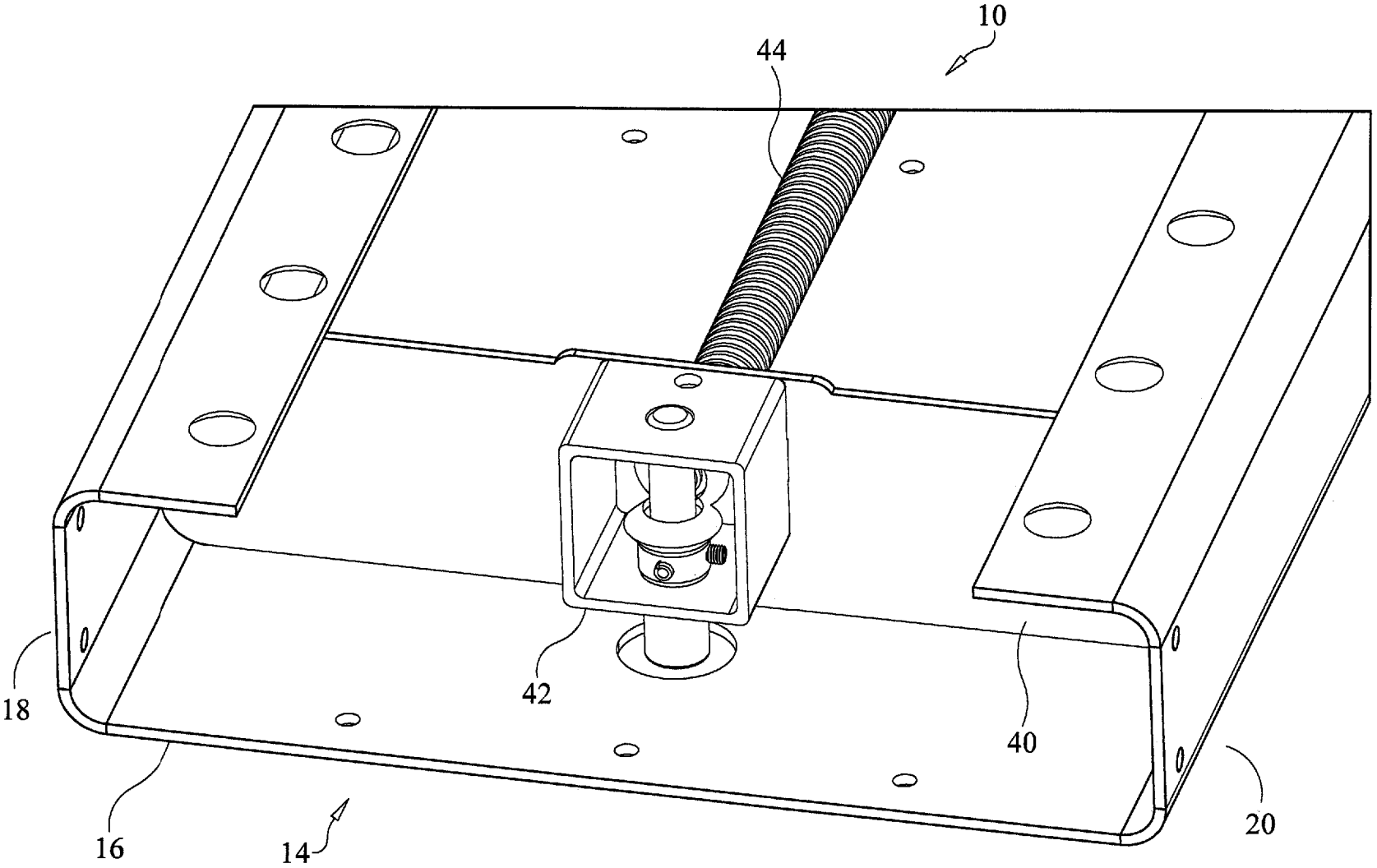
FIG. 4 is an enlarged bottom perspective view of a first end of an outer plank of an adjustable telescoping plank in accordance with the present invention.
Figure 5:
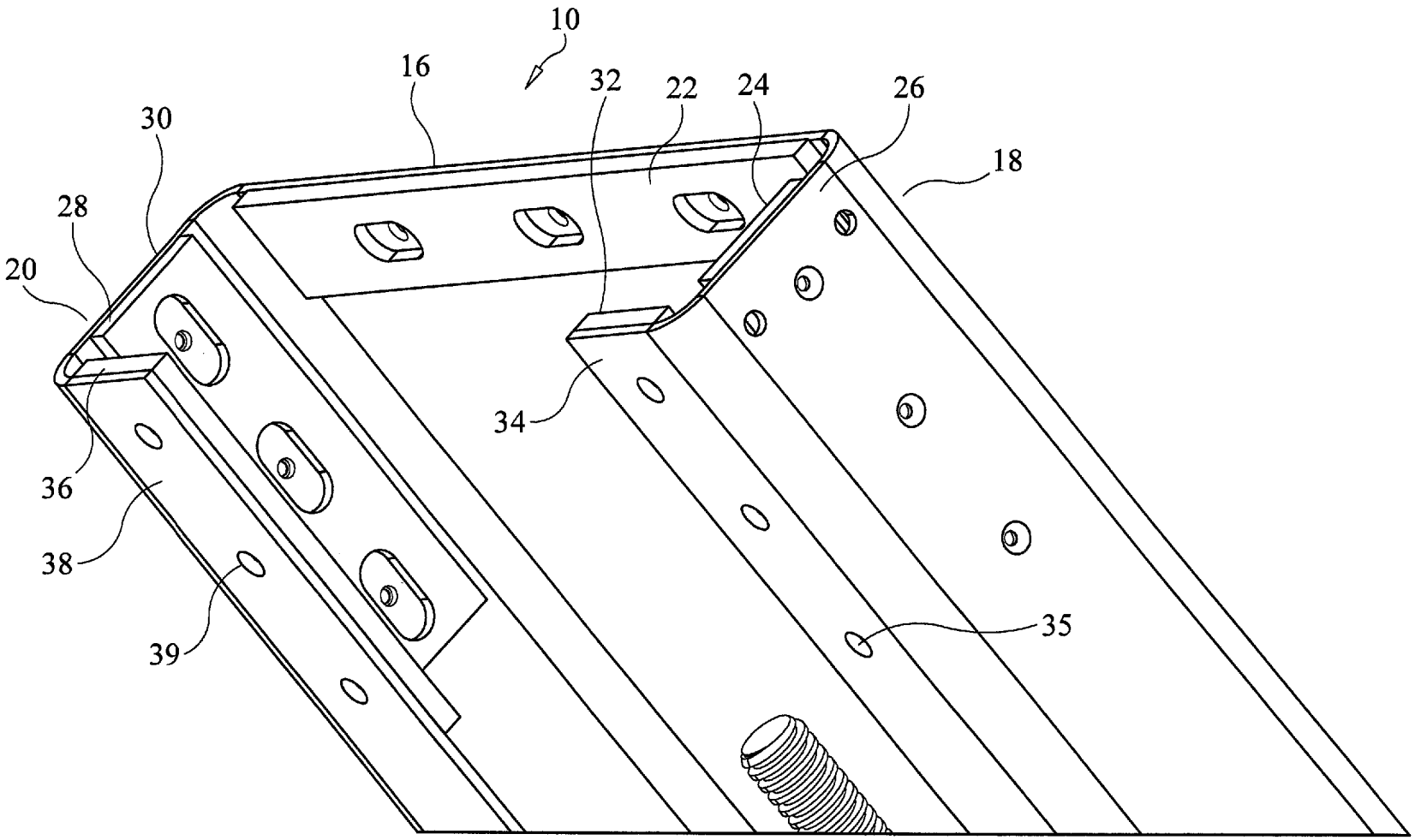
FIG. 5 is an enlarged bottom perspective view of a second end of an outer plank of an adjustable telescoping plank in accordance with the present invention.

With reference now to the drawings, and particularly to FIG. 1, there is shown a perspective view of an adjustable telescoping plank 1. With reference to FIGS. 2-3, the adjustable telescoping plank 1 preferably includes an outer plank 10, an inner plank 12 and a drive device 14. With reference to FIGS. 4-5, the outer plank 10 preferably includes a cross section having a base section 16, a first U-shaped member 18 and a second U-shaped member 20. The first U-shaped member 18 extends from a first side of the base section 16 and the second U-shaped member 20 extends from a second side of the base section 16. The drive device 14 is retained on an inside of substantially a first end of the outer plank 10. A base wear strip 22 is attached to an inside surface of the base section 16 at a second end. A first side wear strip 24 is attached to an inside surface of a first side portion 26 with fasteners or the like of the first U-shaped member 18 at the second end of the outer plank 10. A second side wear strip 28 is attached to an inside surface of a second side portion 30 of the second U-shaped member 20 at the second end of the outer plank 10. A first bottom wear strip 32 is attached to an inside surface of a first bottom portion 34 of the first U-shaped member 18 at the second end. A plurality of first attachment holes 35 are formed through the first bottom portion 34. A second bottom wear strip 36 is attached to an inside surface of a second bottom portion 38 of the second U-shaped member 20 at the second end. A plurality of second attachment holes 39 are formed through said second bottom portion 38.

Figure 6:
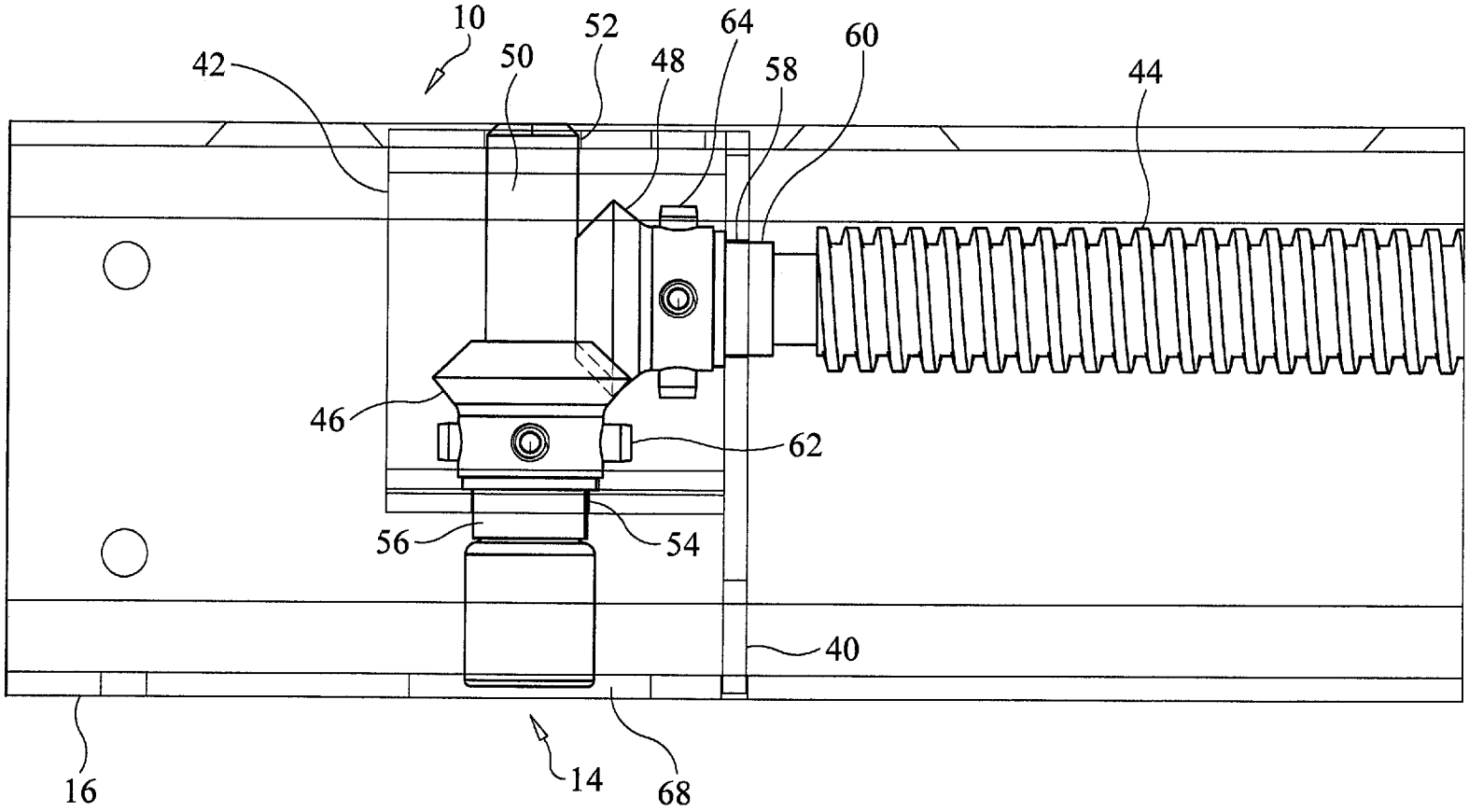
FIG. 6 is an enlarged cross sectional view of a drive device of an outer plank of an adjustable telescoping plank in accordance with the present invention.

With reference to FIG. 6, the drive device 14 preferably includes an adjustment base plate 40, a square tube housing 42, a lead screw 44, a drive gear 46, a driven gear 48 and a drive shaft 50. The drive gear 46 and the driven gear 48 are bevel gears. The base plate 40 and the square tube housing 42 may be replaced with any suitable drive housing. The adjustment base plate 40 is attached to an inside surface of the outer plank 10 at substantially a first end thereof. An end of the tube housing 42 is attached to the base plate 40 at a middle thereof. A lower drive shaft hole 52 and an upper drive shaft hole 54 are formed through a bottom and a top of the tube housing 42 to rotatably retain the drive shaft 50. A drive flanged bearing 56 is preferably retained in the upper drive shaft hole 54. A lead screw hole 58 is formed through the adjustment base plate 40 to rotatably retain a first end of the lead screw 44 or a screw flanged bearing 60. The drive gear 46 is attached to the drive shaft 50 with at least one set-screw 62 or the like. The driven gear 48 is attached to the first end of the lead screw 44 with at least one set-screw 64 or the like. A drive cavity 66 is formed in one end of the drive shaft 50 to receive a drive bit of a manual or motor operated tool. A drive hole 68 is formed through the base plate 16 to provide access to the drive cavity 66. Rotation of the drive shaft 50 rotates the drive gear 46, the driven gear 48 and the lead screw 44.

Figure 7:
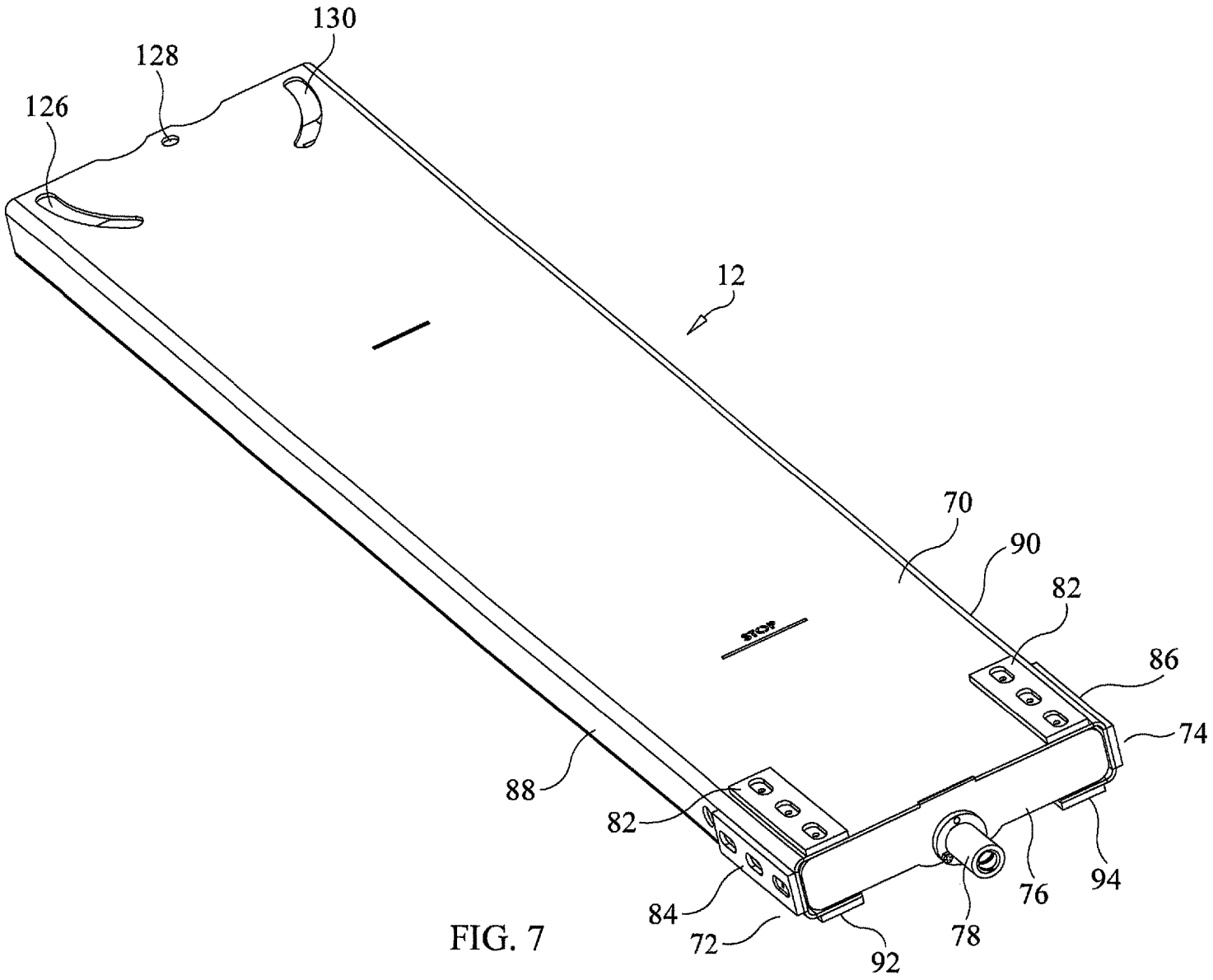
FIG. 7 is a top perspective view of an inner plank of an adjustable telescoping plank in accordance with the present invention.
Figure 8:
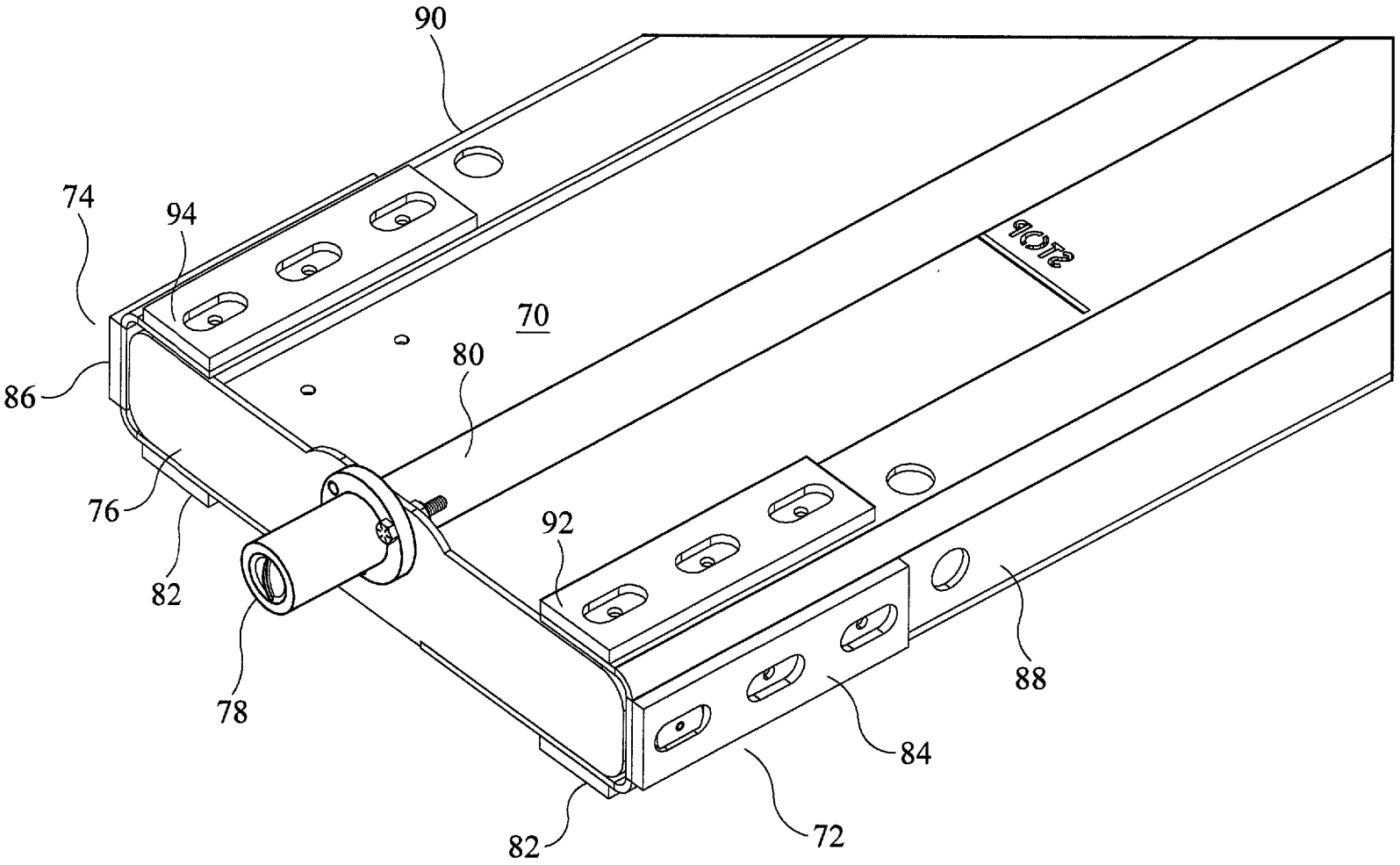
FIG. 8 is a bottom perspective view of a portion of an inner plank of an adjustable telescoping plank in accordance with the present invention.

With reference to FIGS. 7-8, the inner plank 12 preferably includes a cross section having an inner base section 70, a first inner U-shaped member 72 and a second inner U-shaped member 74. The first inner U-shaped member 72 extends from a first side of the inner base section 70 and the second inner U-shaped member 74 extends from a second side of the inner base section 70. An inner end plate 76 is attached to a first end of the inner plank 12. A lead screw nut 78 is attached to a middle and outside surface of the inner end plate 76 to threadably receive the lead screw 44. A lead screw tube 80 is attached concentric with the lead screw nut 78 and on an inside surface of the inner end plate 76. A pair of top wear strips 82 are attached to a top surface of the inner base section 70 at opposing sides and at a first end thereof. A first side wear strip 84 and a second side wear strip 86 are attached to first and second outside side surfaces 88, 90 at opposing sides and at the first end thereof. First and second bottom wear strips 92, 94 are attached to a bottom surface of the first and second inner U-shaped members 72, 74 at the first end thereof.

Figure 9:
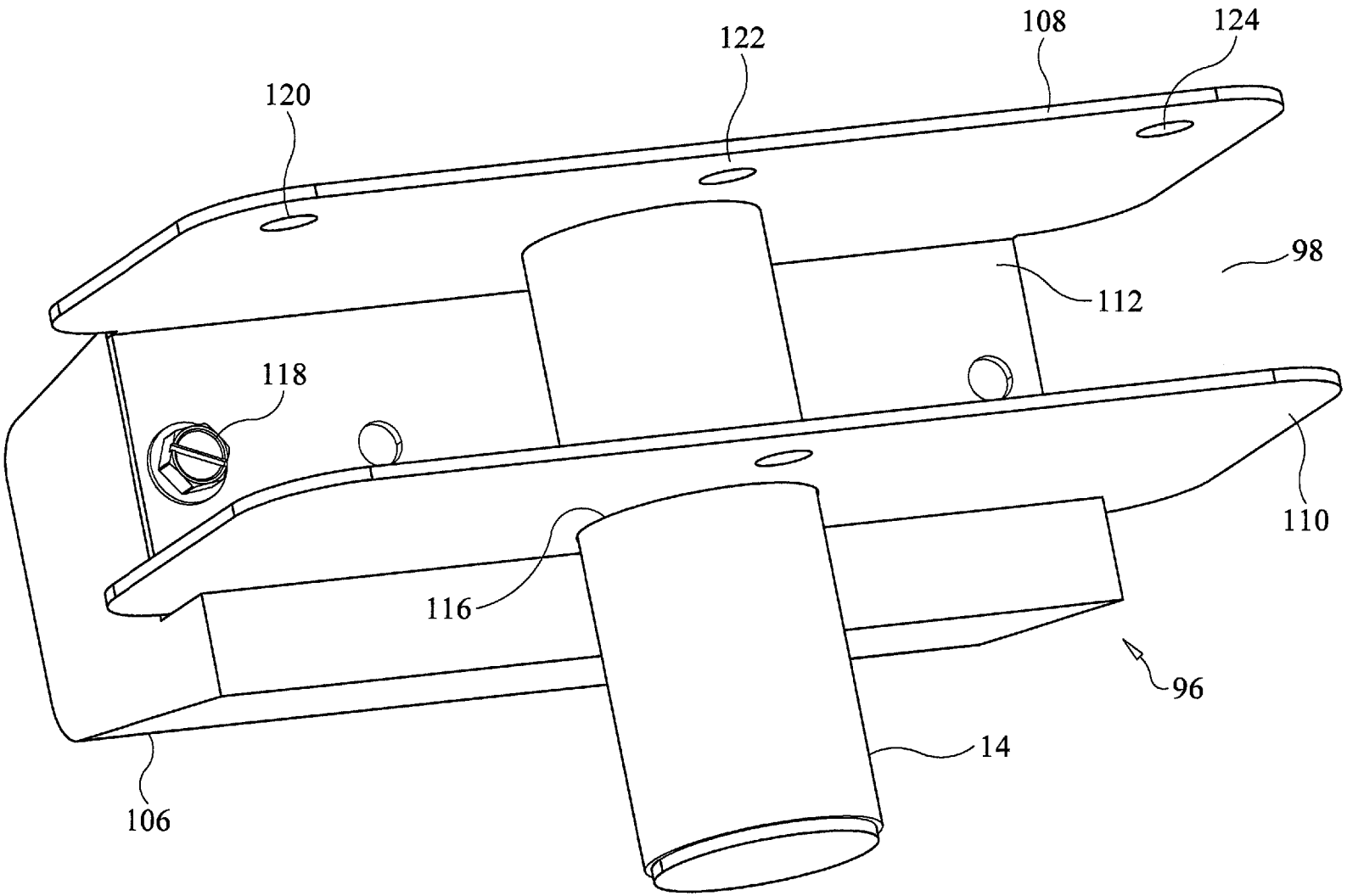
FIG. 9 is a perspective view of a contact member of an adjustable telescoping plank in accordance with the present invention.
Figure 10:
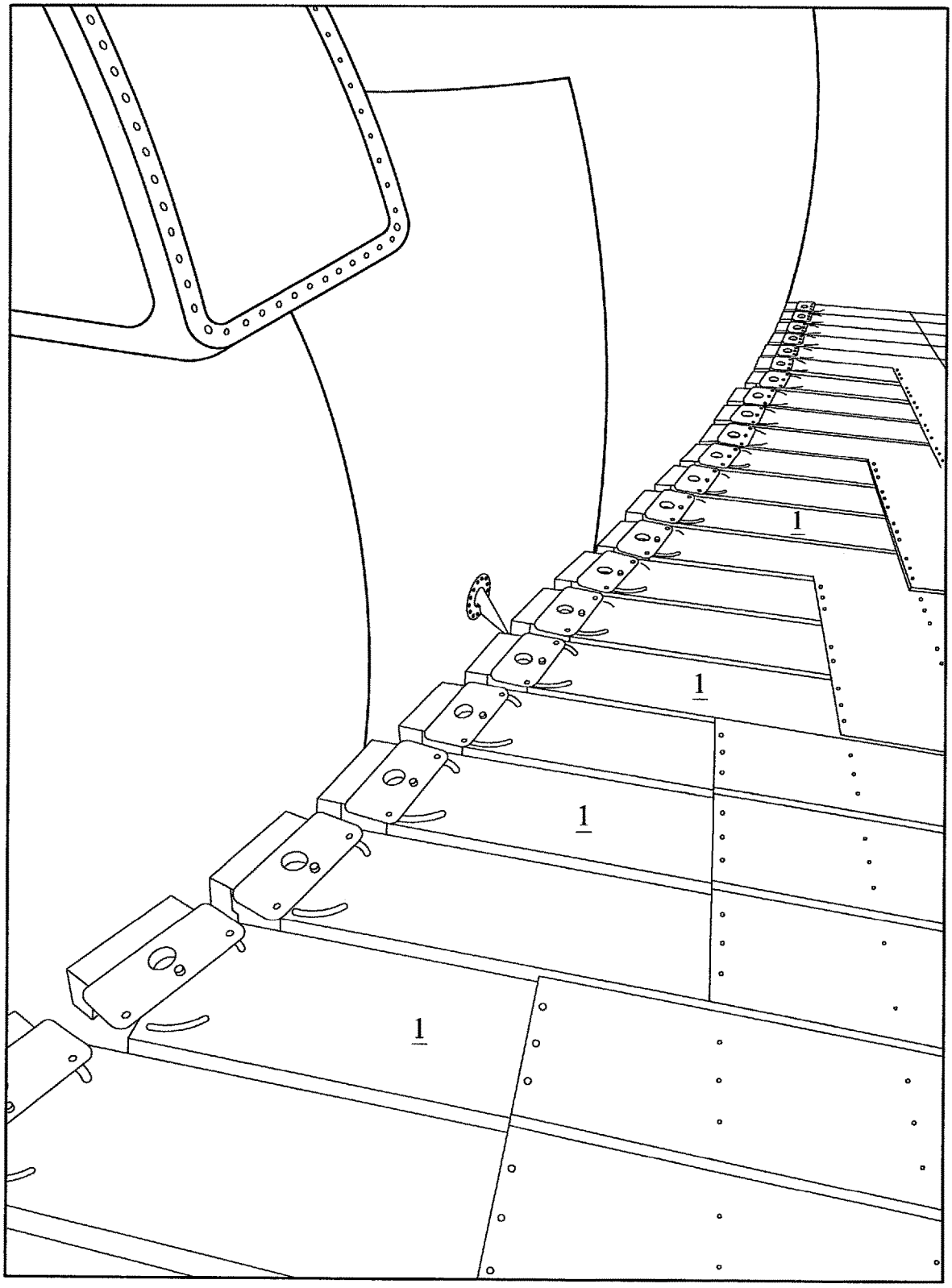
FIG. 10 is a perspective view of a plurality of adjustable telescoping planks arraigned adjacent to each other to provide a support surface for an airplane docking system.

With reference to FIG. 9, a contact member 96 preferably includes a pivoting frame 98 and a contact pad 106. The pivoting frame 98 includes a top plate 108, a bottom plate 110, a front plate 112 and a tube extension 114. The top plate 108 extends backwards from a top edge of the front plate 112. The bottom plate 110 extends backwards from a bottom edge of the front plate 112. A tube hole 116 is formed through the bottom plate to receive tube extension 114. The tube extension 114 is attached to a bottom of the top plate 108 and to the bottom plate 110. The tube extension 114 extends below the bottom plate 110. The contact pad 106 is preferably attached to a front of the front plate 112 with at least one fastener 118. Three pivot holes 120, 122, 124 are formed through the top plate 108. With reference to FIG. 7, if the contact member 96 is used, a first curved slot 126, an inner pivot hole 128 and a second curved slot 130 are formed in a top of the inner plank 12 at a second end. At least one fastener 132 is used to pivotally secure the contact member 96 to the inner plank 12. FIG. 10 shows a plurality of adjustable telescoping planks 1 arraigned adjacent to each other to provide a support surface for an airplane docking system.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable telescoping plank comprising:

a drive device includes a drive shaft and a lead screw, wherein rotation of said drive shaft causes said lead screw to rotate;

an outer plank includes a cross section having a base member and two opposed U-shaped members extending from opposing sides of said base member, said drive shaft is rotatably retained relative to said base member, said lead screw is rotatably retained below said base member;

an inner plank having an inner base member and two inner opposed U-shaped members extending from opposing sides of said inner base member, a lead screw nut is retained on a first end of said inner plank, wherein said inner plank is slidable relative to an inside of said outer plank, rotation of said drive shaft causes said inner plank to axially move relative to said outer plank; and a drive housing is retained in substantially said first end of said outer plank, said lead screw is rotatably retained by said drive housing, said drive housing rotatably retains said drive shaft perpendicular to said lead screw, a drive end of said drive shaft is accessible through a drive hole in said base member of said outer plank.

2. The adjustable telescoping plank of claim 1, further comprising:

a contact member includes a pivoting frame and a contact pad, said contact pad is retained on a front of said pivoting frame, said pivoting frame is pivotally retained on a second end of said inner plank.

3. The adjustable telescoping plank of claim 1 wherein:

a plurality of fastening holes are formed through a bottom portion of said two opposed U-shaped members.

4. The adjustable telescoping plank of claim 1, further comprising:

a lead screw tube is concentric with said lead screw nut and extends inward from said lead screw nut, said lead screw tube is sized to receive said lead screw.

5. An adjustable telescoping plank comprising:

a drive device includes a drive shaft and a lead screw, wherein rotation of said drive shaft causes said lead screw to rotate;

an outer plank includes a cross section having a base member and two opposed U-shaped members extending from opposing sides of said base member, said drive shaft is rotatably retained relative to said base member, said lead screw is rotatably retained below said base member at a first end, at least one wear surface is located on at least one of an inside surface of said base member and said two opposed U-shaped members at a first end thereof; and an inner plank having an inner base member and two inner opposed U-shaped members extending from opposing sides of said inner base member, a lead screw nut is retained on a first end of said inner plank, wherein said inner plank is slidable relative to an inside of said outer plank, rotation of said drive shaft causes said inner plank to axially move relative to said outer plank.

6. The adjustable telescoping plank of claim 5, further comprising:

a contact member includes a pivoting frame and a contact pad, said contact pad is retained on a front of said pivoting frame, said pivoting frame is pivotally retained on a second end of said inner plank.

7. The adjustable telescoping plank of claim 5, further comprising:

a drive housing is retained in substantially said first end of said outer plank, said lead screw is rotatably retained by said drive housing, said drive housing rotatably retains said drive shaft perpendicular to said lead screw.

8. The adjustable telescoping plank of claim 7 wherein:

a drive end of said drive shaft is accessible through a drive hole in said base section of said outer plank.

9. The adjustable telescoping plank of claim 5 wherein:

a plurality of fastening holes are formed through a bottom portion of said two opposed U-shaped members.

10. The adjustable telescoping plank of claim 5, further comprising:

a lead screw tube is concentric with said lead screw nut and extends inward from said lead screw nut, said lead screw tube is sized to receive said lead screw.

11. The adjustable telescoping plank of claim 5 wherein:

said at least one wear surface includes a base strip attached to an inside surface of said base section, a pair of side wear strips are attached to inside surfaces of side portions of said two opposed U-shaped members, a pair of bottom wear strips are attached to inside surfaces of bottom portions of said two opposed U-shaped members.

12. An adjustable telescoping plank comprising:

a drive device includes a drive shaft and a lead screw, wherein rotation of said drive shaft causes said lead screw to rotate;

an outer plank includes a cross section having a base member and two opposed U-shaped members extending from opposing sides of said base member, said drive shaft is rotatably retained relative to said base member, said lead screw is rotatably retained below said base member at a first end, at least one wear surface is located on at least one of an inside surface of said base member and said two opposed U-shaped members at a first end thereof; and an inner plank having an inner base member and two inner opposed U-shaped members extending from opposing sides of said inner base member, a lead screw nut is retained on a first end of said inner plank, at least one second wear surface is formed on an outside surface of said inner base member and said two inner opposed U-shaped members at a second end thereof, wherein said inner plank is slidable relative to an inside of said outer plank, rotation of said drive shaft causes said inner plank to axially move relative to said outer plank.

13. The adjustable telescoping plank of claim 12, further comprising:

a contact member includes a pivoting frame and a contact pad, said contact pad is retained on a front of said pivoting frame, said pivoting frame is pivotally retained on a second end of said inner plank.

14. The adjustable telescoping plank of claim 12, further comprising:

a drive housing is retained in substantially said first end of said outer plank, said lead screw is rotatably retained by said drive housing, said drive housing rotatably retains said drive shaft perpendicular to said lead screw.

15. The adjustable telescoping plank of claim 14 wherein:

a drive end of said drive shaft is accessible through a drive hole in said base section of said outer plank.

16. The adjustable telescoping plank of claim 12 wherein:

a plurality of fastening holes are formed through a bottom portion of said two opposed U-shaped members.

17. The adjustable telescoping plank of claim 12, further comprising:

a lead screw tube is concentric with said lead screw nut and extends inward from said lead screw nut, said lead screw tube is sized to receive said lead screw.

18. The adjustable telescoping plank of claim 12 wherein:

said at least one wear surface includes a base strip attached to an inside surface of said base section, a pair of side wear strips are attached to inside surfaces of side portions of said two opposed U-shaped members, a pair of bottom wear strips are attached to inside surfaces of bottom portions of said two opposed U-shaped members.

* * * * *